US005667943A

United States Patent [19]

Boggs et al.

[11] Patent Number: 5,667,943

[45] Date of Patent: Sep. 16, 1997

[54] PROCESS FOR THERMOCHEMICAL GENERATION OF ACID AND FOR THERMAL IMAGING, AND IMAGING MEDIUM FOR USE THEREIN

[75] Inventors: Roger A. Boggs, Wayland; Jurgen M. Grasshoff, Hudson; Mark R. Mischke, Arlington; Anthony J. Puttick, Arlington; Stephen J. Telfer, Arlington; David P. Waller, Lexington; Kenneth C. Waterman, Arlington, all of Mass.

[73] Assignee: Polaroid Corporation, Cambridge, Mass.

[21] Appl. No.: 630,967

[22] Filed: Apr. 8, 1996

Related U.S. Application Data

[62] Division of Ser. No. 345,073, Nov. 28, 1994, Pat. No. 5,534,393, which is a division of Ser. No. 106,353, Aug. 13, 1993, Pat. No. 5,401,619, which is a division of Ser. No. 965,172, Oct. 23, 1992, Pat. No. 5,278,031.

[51] Int. Cl.[6] ..... G03C 1/725; G03C 1/73; G03C 1/35

[52] U.S. Cl. ..... 430/343; 430/346; 430/348; 430/333; 430/336; 430/340; 430/203; 430/261; 430/270.1

[58] Field of Search ..... 430/343, 340, 430/346, 348, 333, 336, 203, 269, 270.1

[56] References Cited

U.S. PATENT DOCUMENTS

| | | | |
|---|---|---|---|
| 3,488,705 | 1/1970 | Fox et al. | 96/1.6 |
| 3,723,121 | 3/1973 | Hauser et al. | 96/27 |
| 3,745,009 | 7/1973 | Jenkins et al. | 96/84 R |
| 3,832,212 | 8/1974 | Jenkins et al. | 117/36.7 |
| 4,092,146 | 5/1978 | Fischer et al. | 71/70 |
| 4,159,387 | 6/1979 | Bellus | 560/185 |
| 4,242,440 | 12/1980 | Yee et al. | 430/346 |
| 4,258,118 | 3/1981 | Foley et al. | 430/221 |
| 4,258,119 | 3/1981 | Cournoyer et al. | 430/221 |
| 4,290,950 | 9/1981 | Cournoyer et al. | 260/326.12 R |
| 4,290,951 | 9/1981 | Foley et al. | 260/326.12 R |
| 4,290,955 | 9/1981 | Cincotta et al. | 260/336 |
| 4,304,834 | 12/1981 | Cournoyer et al. | 430/221 |
| 4,307,017 | 12/1981 | Cournoyer et al. | 260/239.95 |
| 4,310,673 | 1/1982 | Foley et al. | 548/207 |
| 4,311,847 | 1/1982 | Cournoyer et al. | 548/207 |
| 4,316,950 | 2/1982 | Cincotta et al. | 430/221 |
| 4,345,017 | 8/1982 | Cournoyer et al. | 430/221 |
| 4,380,629 | 4/1983 | Yamashita et al. | 542/455 |
| 4,416,971 | 11/1983 | Borrer et al. | 430/221 |
| 4,429,142 | 1/1984 | Cournoyer et al. | 549/394 |
| 4,508,811 | 4/1985 | Gravesteijn et al. | 430/270 |
| 4,602,263 | 7/1986 | Borrer et al. | 346/201 |
| 4,603,101 | 7/1986 | Crivello | 430/270 |
| 4,617,402 | 10/1986 | Borrer et al. | 548/455 |
| 4,624,904 | 11/1986 | Kazmaier et al. | 430/59 |
| 4,707,427 | 11/1987 | Tanaka et al. | 430/59 |
| 4,720,449 | 1/1988 | Borrer et al. | 430/338 |
| 4,751,163 | 6/1988 | Hagiwara et al. | 430/59 |
| 4,825,408 | 4/1989 | Potember et al. | 365/113 |
| 4,826,976 | 5/1989 | Borrer et al. | 544/58.4 |
| 4,833,053 | 5/1989 | Wurster | 430/58 |
| 4,916,046 | 4/1990 | Doessel | 430/281 |
| 5,118,861 | 6/1992 | Jackson et al. | 568/347 |
| 5,153,104 | 10/1992 | Rossman et al. | 430/340 |
| 5,278,031 | 1/1994 | Boggs et al. | 430/348 |
| 5,401,619 | 3/1995 | Boggs et al. | 430/343 |
| 5,534,393 | 7/1996 | Boggs et al. | 430/348 |

OTHER PUBLICATIONS

Bou et al., Tetrahedron Letters, 23(3), 361 (1982).

Cohen S. and Cohen, S. G., J. Am. Chem. Soc., 88, 1533 (1966).

Dehmlow et al., Chem. Ber. 113(1), 1–8 (1979).

Dehmlow et al., Chem. Ber. 12(3), 569–71 (1988).

Greene, Theodora W., Protective Groups in Organic Synthesis, New York, Wiley, 1981, p. 326.

Pericas et al., Tetrahedron Letters, (1977), 4437–38.

Reynolds and Drexhage, J. Org. Chem., 42(5), 885–888 (1977).

Sabongi, G.J. Chemical Triggering—Reactions of Potential Utility in Industrial Processes, Plenum Press, New York.

*Primary Examiner*—Geraldine Letscher
*Attorney, Agent, or Firm*—David J. Cole

[57] ABSTRACT

Certain squaric acid derivatives are useful for the thermochemical generation of acid. The squaric acid derivatives may be used in imaging media in conjunction with acid-sensitive materials which undergo a color change when contacted by the acid generated from the squaric acid derivatives. Preferably, the acid-sensitive materials undergo an irreversible color change, so that the image can be fixed by neutralizing all the acid generated with excess base, thereby preventing further color change in the image during long term storage.

11 Claims, 3 Drawing Sheets

PROCESS FOR THERMOCHEMICAL GENERATION OF ACID AND FOR THERMAL IMAGING, AND IMAGING MEDIUM FOR USE THEREIN

REFERENCE TO RELATED APPLICATIONS

This application is a division of application Ser. No. 08/345,073, filed Nov. 28, 1994, now U.S. Pat. No. 5,534, 393, which itself is a division of application Ser. No. 08/106,353, filed Aug. 13, 1993, now U.S. Pat. No. 5,401, 619, which itself is a division of application Ser. No. 07/965,172, filed Oct. 23, 1992, now U.S. Pat. No. 5,278, 031.

Attention is directed to copending application Ser. No. 07/965,162, filed Oct. 23, 1992, now U.S. Pat. No. 5,334, 489, assigned to the same assignee as the present application; this copending application describes and claims a process and imaging medium generally similar to those of the present invention, but in which the initial generation of acid is effected by the impact of radiation upon a superacid precursor.

Attention is also directed to copending application Ser. No. 07/965,161, filed Oct. 23, 1992, now U.S. Pat. No. 5,286,612 assigned to the same assignee as the present application; this copending application describes and claims a process and imaging medium generally similar to those of the present invention but in which acid is generated using a mixture of an infra-red dye, a superacid precursor and an acid-sensitive acid generator. This mixture is exposed to an imagewise exposure to infra-red radiation, followed by a blanket exposure to ultra-violet radiation.

BACKGROUND OF THE INVENTION

This invention relates to a process for thermochemical generation of acid and for thermal imaging, and to an imaging medium for use in this thermal imaging process.

Thermal imaging processes are known which use a material capable of undergoing a color change from a colorless to a colored form, from one color to another color or from a colored to a colorless form upon application of heat. For example, U.S. Pat. No. 3,723,121 discloses several thermochromic materials for laser beam recording including inorganic compounds, such as black copper (II) oxide, which decomposes to red copper (I) oxide upon heating, and organic compounds, such as polyacetylene compounds, which subsequent to treatment with ultraviolet light undergo two changes in color, first to red then to yellow, as the temperature is increased.

U.S. Pat. No. 4,720,449 describes a thermal imaging method which comprises heating imagewise a di- or triarylmethane compound possessing within its di- or triarylmethane structure an aryl group substituted in the ortho position to the meso carbon atom with a moiety ring-closed on the meso carbon atom directly through a nitrogen atom, which nitrogen atom is also bound to a group with a masked acyl substituent that undergoes fragmentation upon heating to liberate the acyl group for effecting intramolecular acylation of the nitrogen atom to form a new group in the ortho position, whereby the di- or triarylmethane compound is rendered colored in an imagewise pattern corresponding to the imagewise heating.

U.S. Pat. No. 4,602,263 and U.S. Pat. No. 4,826,976 both describe thermal imaging systems for optical recording and particularly for forming color images. This thermal imaging method relies upon the irreversible unimolecular fragmentation of one or more thermally unstable carbamate moieties of an organic compound to effect a visually discernible color shift from colorless to colored, from colored to colorless or from one color to another. In both references, the preferred method of producing the heat required for the irreversible unimolecular fragmentation is to include in the imaging medium an infra-red absorber which generates heat upon exposure to infra-red radiation, and then to imagewise expose the imaging medium to infra-red radiation.

All thermal imaging systems which rely upon a heat-induced color change in a single material potentially suffer from the problem that, although the color change only occurs rapidly at an elevated temperature, the color change will continue at some finite, though low rate, at lower temperatures, such as ambient temperatures at which the relevant imaging medium is normally stored prior to exposure and at which the formed images are stored after exposure. Development of slight color in the imaging medium prior to exposure results in an increased minimum optical density ($D_{min}$) in the image; in other words, the white portions of the image appear less white the longer the imaging medium is stored prior to exposure. Similarly, continuing color change after exposure, especially in unexposed regions of the image where the original heat-sensitive material is not decomposed during exposure, may, over a period of years, result in increased optical density in unexposed regions and a consequent loss of contrast in the image. These problems caused by unwanted color change may be exacerbated in polychrome systems by the fact that, at storage temperatures, the rates of decomposition of the various heat-sensitive materials used to produce the various colors may differ, so that when the optical density of supposedly white or grey areas of the image changes on storage, these areas may develop a colored tint rather than remaining a neutral white or grey.

The heat-sensitive materials disclosed in the aforementioned U.S. Pat. Nos. 4,602,263 and 4,826,976 comprise single compounds the molecules of which may be regarded as having a relatively small heat-sensitive center (typically a t-butoxycarbonyl group) covalently linked to a much larger chromophore (typically a polysubstituted xanthene nucleus). There are theoretical advantages to replacing such a covalently-linked compound with a two-component system comprising a small molecule which generates acid upon heating and a larger molecule which changes color upon contact with acid. Polychrome forms of such a two component system would require only a single heat-sensitive compound. By including a small amount of base with the heat-sensitive compound and the acid-sensitive compound, small amounts of acid generated during storage of the imaging medium prior to exposure could be neutralized, thereby avoiding an increase in $D_{min}$ in the unexposed areas of the image. Finally, such a two-component system could contain an excess of the low molecular weight heat-sensitive compound and only the amount of the high molecular weight acid-sensitive compound needed to produce the desired maximum optical density ($D_{max}$) in the image. Such a system with excess heat-sensitive compound is likely to be more sensitive than a single component system, since part of the heat-sensitive material normally remains unchanged even in areas of maximum optical density; in the two-component system, use of excess low molecular weight heat-sensitive compound can compensate for its incomplete thermal breakdown without greatly increasing the mass of material to be heated, whereas a corresponding attempt to increase the amount of heat-sensitive centers in a single component system necessarily increases the amount of the high molecular weight molecule, thereby greatly increasing the mass of material to be heated.

Heat-sensitive materials which liberate acid upon heating are known. For example, Sabongi, G. J., Chemical Triggering—Reactions of Potential Utility in Industrial Processes, Plenum Press, New York, N.Y. (1987), pages 68–72 describes thermally triggered release of carboxylic acids from esters and oxime derivatives, especially benzaldoximes and oxalic acid esters, while pages 97–101 of the same work describe photochemical release of carboxylic acids from benzyl, phenacyl, sulfenyl and benzoin esters.

U.S. Pat. No. 4,603,101 describes photoresist compositions containing a compound which photochemically generates acid. The acid-generating compounds used are onium salts.

U.S. Pat. No. 4,916,046, issued Apr. 10, 1990, on application Ser. No. 243,819, filed Sep. 13, 1988, describes a positive radiation-sensitive mixture using a monomeric silylenol ether, and a recording medium produced therefrom. This patent also contains an extensive discussion of radiation-sensitive compositions which form or eliminate an acid on irradiation. According to this patent, such radiation-sensitive compositions include diazonium, phosphonium, sulfonium and iodonium salts, generally employed in the form of their organic solvent-soluble salts, usually as deposition products with complex acids such as tetrafluoroboric acid, hexafluorophosphoric acid, hexafluoroantimonic acid and hexafluoroarsenic acid; halogen compounds, in particular triazine derivatives; oxazoles, oxadiazoles, thiazoles or 2-pyrones which contain trichloromethyl or tribromomethyl groups; aromatic compounds which contain ring-bound halogen, preferably bromine; a combination of a thiazole with 2-benzoylmethylenenaphthol; a mixture of a trihalomethyl compound with N-phenylacridone; α-halocarboxamides; and tribromomethyl phenyl sulfones.

A heat-sensitive acid generating material needs to fulfil several differing requirements. It is desirable that the material generate a strong acid, since generation of a weak acid, such as the carboxylic acids generated by some of the materials discussed above, may limit the types of acid-sensitive compound which can be used. The heat-sensitive acid generating material is desirably of low molecular weight in order to reduce the amount of material required to generate a specific amount of acid, and also to reduce the amount of energy required to heat the material to its decomposition temperature. The acid generating material should decompose rapidly when heated to its acid-forming temperature, and this temperature should not be higher than about 130° C., in order to reduce the amount of energy which must be supplied to decompose the acid generating material and thus reduce the energy necessary for acid formation in a medium, and increase the sensitivity of the medium. Finally, the acid generating material must be compatible with all the other components of the imaging medium in which it is to be used, and should not pose environmental problems, such as offensive smell or severe toxicity.

It has now been found that certain squaric acid derivatives are effective as heat-sensitive acid generating materials, and that these derivatives are useful in thermal imaging.

SUMMARY OF THE INVENTION

This invention provides a process for thermochemical generation of acid, which comprises heating a 3,4-disubstituted-cyclobut-3-ene-1,2-dione in which at least one of the 3- and 4-substituents consists of an oxygen atom bonded to the squaric acid ring, and an alkyl or alkylene group, a partially hydrogenated aryl or arylene group, or an aralkyl group, bonded to the oxygen atom, the 3,4-disubstituted-cyclobut-3-ene-1,2-dione being capable of thermally decomposing so as to cause replacement of the or each original alkoxy, alkyleneoxy, aryloxy, aryleneoxy or aralkyloxy group of the derivative with a hydroxyl group, thereby producing squaric acid or an acidic squaric acid derivative having one hydroxyl group, the heating being continued for a temperature and time sufficient to produce squaric acid or the acidic squaric acid derivative.

This invention also provides an imaging medium comprising:

a 3,4-disubstituted-cyclobut-3-ene-1,2-dione in which at least one of the 3- and 4-substituents consists of an oxygen atom bonded to the squaric acid ring, and an alkyl or alkylene group, a partially hydrogenated aryl or arylene group, or an aralkyl group, bonded to the oxygen atom, the 3,4-disubstituted-cyclobut-3-ene-1,2-dione being capable of thermally decomposing so as to cause replacement of the or each original alkoxy, alkyleneoxy, aryloxy, aryleneoxy or aralkyloxy group of the derivative with a hydroxyl group, thereby producing squaric acid or an acidic squaric acid derivative having one hydroxyl group; and an acid sensitive material which changes color in the presence of the squaric acid or acidic squaric acid derivative liberated when the 3,4-disubstituted-cyclobut-3-ene-1,2-dione is decomposed by heat.

For simplicity, the 3,4-disubstituted-cyclobut-3-ene-1,2-dione used in the process and medium of the present invention may hereinafter be referred to as a "squaric acid derivative", while the acidic squaric acid derivative produced by thermal decomposition of the 3,4-disubstituted-cyclobut-3-ene-1,2-dione may hereinafter be referred to as the "acidic derivative."

Finally, this invention provides, as new compounds, squaric acid derivatives selected from the group consisting of:

3,4-bis(3-bromo-2,3-dimethylbut-2-oxy)-cyclobut-3-ene-1,2-dione;

3-t-butoxy-4-phenylcyclobut-3-ene-1,2-dione;

3,4-bis(α-methylbenzyloxy)-cyclobut-3-ene-1,2-dione;

3,4-bis(p-methylbenzyloxy)-cyclobut-3-ene-1,2-dione;

3,4-bis(cyclohexyloxy)-cyclobut-3-ene-1,2-dione;

3-amino-4-(t-butoxy)-cyclobut-3-ene-1,2-dione;

4-hexyl-3-(p-vinylbenzyloxy)-cyclobut-3-ene-1,2-dione;

3-amino-4-(p-vinylbenzyloxy)-cyclobut-3-ene-1,2-dione; and

4-[5-[1,2-dioxo-3-[4-methyl-benzyloxy]-cyclobut-3-en-4-yl]pent-1-yl]-3-[4-methylbenzyloxy]-cyclobut-3-ene-1,2-dione.

DETAILED DESCRIPTION OF THE INVENTION

Figure 1:
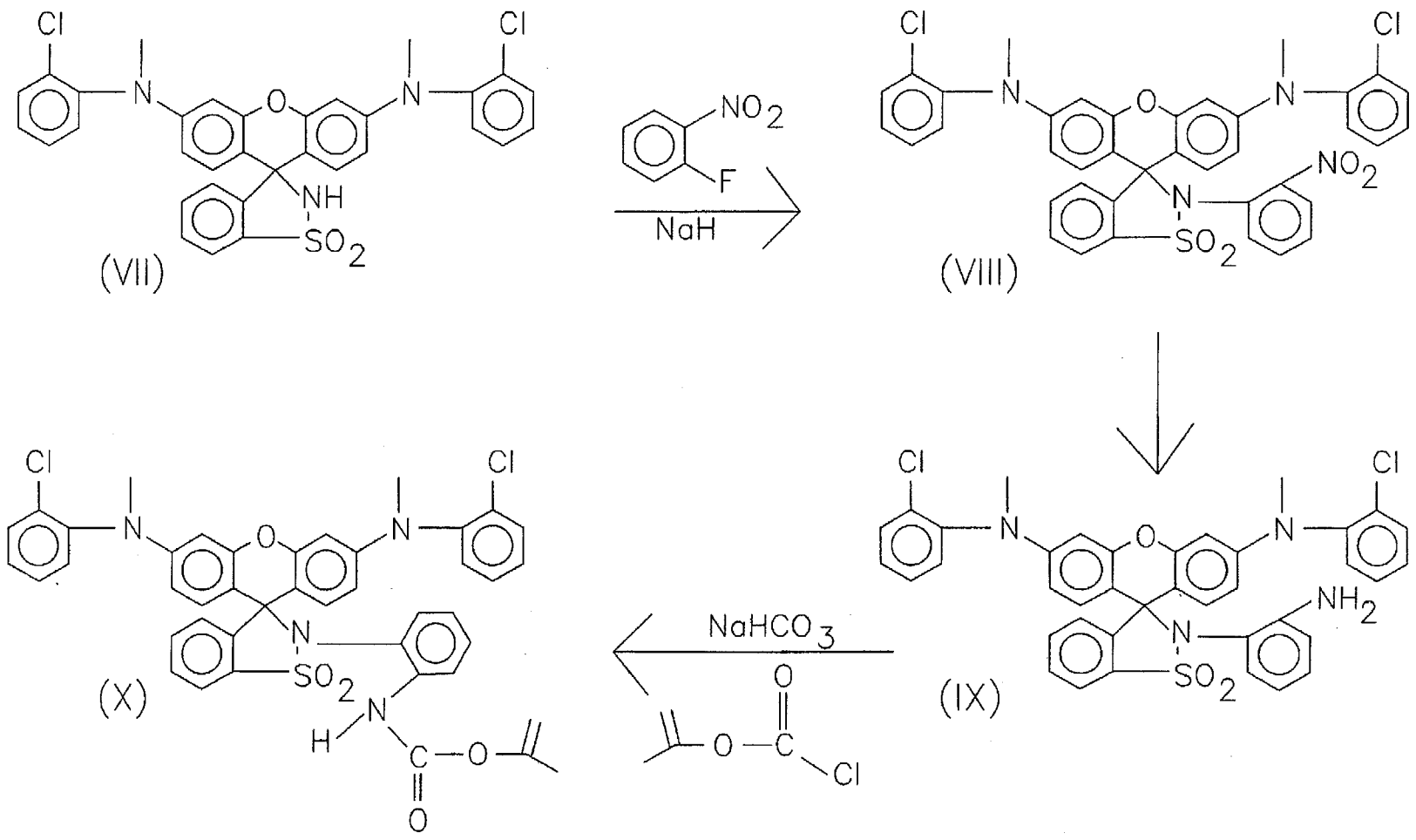
FIG. 1 of the accompanying drawings shows a synthesis of the preferred leuco dye for use in the imaging medium of the present invention.

As already mentioned, the present process employs a squaric acid derivative in which there is bonded to the squaric acid ring, via an oxygen atom, an alkyl or alkylene group, a partially hydrogenated aryl or arylene group, or an aralkyl group, and the heating of this squaric acid derivative is continued for a temperature and time sufficient to produce squaric acid or an acidic derivative thereof. The thermal decomposition of the squaric acid derivative causes replacement of the original alkoxy, alkyleneoxy, aryloxy, aryleneoxy or aralkyloxy group of the derivative with a hydroxyl group, thereby producing squaric acid or an acidic squaric acid derivative having one hydroxyl group.

The exact mechanism by which squaric acid or an acidic derivative thereof is formed in the present process may vary depending upon the type of squaric acid derivative heated. In some cases, for example di-t-butyl squarate, one or both groups attached via oxygen atoms to the squaric acid ring may thermally decompose to yield an alkene or arene, thereby converting an alkoxy or aryloxy group to a hydroxyl group and forming the squaric acid or acidic derivative thereof. In other cases, for example 3-amino-4-(p-vinylbenzyloxy)cyclobut-3-en-1,2-dione, there is no obvious mechanism for formation of a corresponding alkene or arene, and it appears that the mechanism of acid formation is migration of the vinylbenzyl or similar group to a different position within the molecule (probably to the amino group), and protonation of the remaining oxygen atom to form a hydroxyl group at the position from which the group migrates. In other cases, neither of these pathways is possible. However, in both cases the net effect is the replacement of the alkoxy, alkyleneoxy, aryloxy, aryleneoxy or aralkoxy group present in the original derivative with a hydroxyl group to form squaric acid or an acidic derivative thereof.

There are four preferred groups of squaric acid derivatives for use in the present process:

(a) those of the formula:

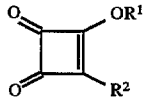

(I)

in which $R^1$ is an alkyl group, a partially hydrogenated aromatic group, or an aralkyl group, and $R^2$ is a hydrogen atom or an alkyl, cycloalkyl, aralkyl, aryl, amino, alkylamino, dialkylamino, alkylthio, alkylseleno, dialkylphosphino, dialkylphosphoxy or trialkylsilyl group, subject to the proviso that either or both of the groups $R^1$ and $R^2$ may be attached to a polymer. Among the derivatives of Formula I, especially preferred groups are those in which (a) $R^1$ is an unsubstituted or phenyl substituted alkyl group containing a total of not more than about 20 carbon atoms in which the carbon atom directly bonded to the oxygen atom has not more than one hydrogen atom attached thereto, and $R^2$ is an alkyl group containing not more than about 20 carbon atoms, or a phenyl group (which may be substituted or unsubstituted); and (b) $R^1$ is a benzyloxy group and $R^2$ is an amino group.

(b) those of the formula:

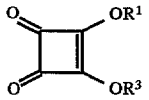

(II)

in which $R^1$ and $R^3$ independently are each an alkyl group, a partially hydrogenated aryl group or an aralkyl group, subject to the proviso that either or both of the groups $R^1$ and $R^3$ may be attached to a polymer. Among the derivatives of Formula II, an especially preferred group are those in which $R^1$ and $R^3$ are each independently an unsubstituted or phenyl substituted alkyl group containing a total of not more than about 20 carbon atoms in which the carbon atom directly bonded to the oxygen atom has not more than one hydrogen atom attached thereto. Specific preferred compounds of Formula II are those in which $R^1$ and $R^3$ are each a tertiary butyl group, an α-methylbenzyl group or a cyclohexyl group, namely di-tertiary butyl squarate, bis(α-methylbenzyl) squarate) and dicyclohexyl squarate.

(c) those of the formula:

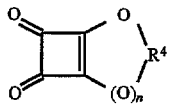

(III)

in which n is 0 or 1, and $R^4$ is an alkylene group or a partially hydrogenated arylene group. Among the derivatives of Formula III, an especially preferred group are those in which n is 1 and $R^4$ is an alkylene group containing not more than about 12 carbon atoms, in which each of the carbon atoms directly bonded to the oxygen atoms has not more than one hydrogen atom attached thereto.

(d) those having at least one unit of the formula:

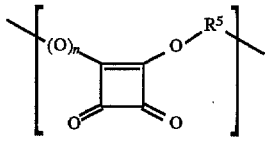

(IV)

in which n is 0 or 1, and $R^5$ is an alkylene or partially hydrogenated arylene group. In addition to the fragmentable groups $R^5$, the compounds may also contain one or more units in which a non-fragmentable group is attached to a squarate ring, directly or via an oxygen atom.

The squaric acid derivatives of Formula IV include not only high polymers, but also dimers, trimers, tetramers, etc. including at least one of the specified units. The terminating groups on the derivatives of Formula IV may be any of groups $OR^1$ or $R^2$ discussed above with reference to Formula I. Thus, for example, Formula IV includes the squaric acid dimer derivative of the formula:

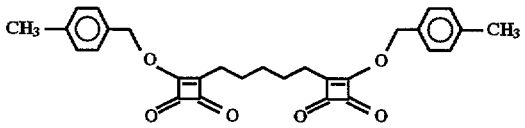

The squaric acid derivatives of Formulae I and II are usually monomeric. However, these derivatives of Formulae I and II can be incorporated into polymers by having at least one of the groups $R^1$, $R^2$ and $R^3$ attached to a polymer. Attachment of the squaric acid derivatives to a polymer in this manner may be advantageous in that it may avoid incompatibility and/or phase separation which might occur between a monomeric squaric acid derivative of Formula I or II and a polymeric binder needed in an imaging medium.

The attachment of the groups $R^1$, $R^2$ and $R^3$ to a polymer may be effected in various ways, which will be familiar to those skilled in the art of polymer synthesis. The squaric acid derivatives may be incorporated into the backbone of a polymer; for example, the groups may contain unsaturated linkages which enable the squaric acid derivatives to be polymerized either alone or in admixture with other unsaturated monomers. Alternatively, the squaric acid derivatives may be added as sidechains to a polymer; for example, one of the groups $R^1$, $R^2$ and $R^3$ could contain an amino group able to react with a polymer containing a carboxyl groups or derivatives thereof to form an amide linkage which would link the squaric acid derivative as a sidechain on to the polymer.

In the present process, it is generally undesirable to form substantial quantities of gas during the thermal decomposition of the squaric acid derivative since such gas may distort the medium containing the squaric acid derivative or form vesicles therein, and such distortion or vesicle formation may interfere with proper image formation. Accordingly, if the thermal decomposition of the squaric acid derivative yields an alkene, it is desirable that the groups $R^1$, $R^3$, $R^4$ and $R^5$ be chosen so that this alkene is a liquid at 20° C., and preferably higher, since some heating of the alkane will inevitably occur during the thermal decomposition. In some cases, however, the alkane liberated may be sufficiently soluble in the medium containing the squaric acid derivative that liberation of a highly volatile alkane will not result in distortion of, or vesicle formation in, the medium.

Although the present process may be used for other purposes, such as thermochemical triggering of an acid-catalyzed chemical reaction, it is primarily intended for use in image formation processes, and thus the heating of the squaric acid derivative is desirably effected in the presence of an acid-sensitive material which changes color in the presence of the squaric acid or acidic derivative thereof liberated by the thermal decomposition of the squaric acid derivative, and the heating of the squaric acid derivative is effected in an imagewise manner so that the color change of the acid-sensitive material occurs only in areas which are heated, thereby forming an image.

The acid-sensitive material used in the process of the present invention may be any material which undergoes a color change in the presence of acid. Thus any conventional indicator dye may be used as the acid-sensitive material, as may the leuco dyes disclosed in the aforementioned U.S. Pat. Nos. 4,602,263; 4,720,449 and 4,826,976, which are also sensitive to acid. However, preferably the acid-sensitive material is one which undergoes an irreversible color change in the presence of the squaric acid or acidic derivative thereof, such that subsequent neutralization of the squaric acid or acidic derivative thereof does not reverse the color change. As described in more detail below, the use of such an irreversible acid-sensitive material allows the image to be fixed, following the heating, by contacting the exposed imaging medium with a base.

Preferred irreversible acid-sensitive materials for use in the present process are those of the formula:

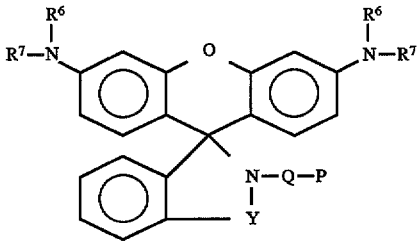

(V)

wherein:

each $R^6$ and $R^7$ independently is a group which, together with the intervening nitrogen atom, forms a auxochromic group, subject to the proviso that each adjacent $R^6$ and $R^7$ together with the intervening nitrogen atom may form a nitrogen-containing heterocyclic nucleus;

Y is an $SO_2$ or carbonyl group;

P is a leaving group which can separate from the remainder of the leuco dye molecule after protonation of the leuco dye molecule; and Q is a group containing an atom which is not bonded to the nitrogen atom attached to groups Y and Q but which, subsequent to protonation of group P, can form a second bond between group Q and this nitrogen atom, thereby forming a nitrogen-containing heterocyclic ring including this nitrogen atom and at least two atoms of group Q, the formation of this second bond being accompanied by the rupture of the bond between the nitrogen atom and the spiro carbon atom to which it is attached.

The color-forming reactions which the leuco dyes of Formula V undergo in the presence of acid are for practical purposes irreversible. Although thermodynamically no chemical reaction is completely irreversible, by "for practical purposes irreversible" is meant that the color produced is not discharged or substantially reduced in intensity by contact with basic materials, and that the color is not discharged or substantially reduced in intensity by storage at temperatures of about 0° C. to 30° C. for six months.

In the leuco dyes of Formula V, preferably each of the groups $R^6$ and $R^7$ independently is a substituted or unsubstituted alkyl or aryl group, or each adjacent $R^6$ and $R^7$ together with the intervening nitrogen atom forms a nitrogen-containing heterocyclic nucleus. Especially preferred are those leuco dyes in which each of the groups $R^6$ and $R^7$ is a methyl or halophenyl group, or each adjacent $R^6$ and $R^7$ together with the intervening nitrogen atom forms an indolinyl group. Also, preferably Y is an $SO_2$ group. P may be a leaving group which upon protonation of the leuco dye causes departure of a ketone, hydroxy-nitrogenous heterocycle or alkanol molecule. Preferred groups P are those which upon protonation of the leuco dye cause departure of an acetone or pyridone molecule, for example an —O—C(=$CH_2$)$CH_3$ group.

Preferably, the heterocyclic ring formed during the production of the colored product from the leuco dye is a five-membered heterocyclic ring containing one nitrogen atom and four carbon atoms or two nitrogen atoms and three carbon atoms; such five-membered rings form easily and are stable. Desirably, such a five-membered ring is fused to at least one benzene ring. Especially preferred groups Q are —Ar—NH—C(=O)— and —Ar—CH=CH— groups, wherein Ar is an aromatic nucleus, desirably an o-phenylene nucleus.

Specific preferred leuco dyes of Formula V are those in which each $R^6$ is a methyl group, and each $R^7$ is a o-chlorophenyl group, or each adjacent $R^6$ and $R^7$ together with the intervening nitrogen atom forms an indolinyl group; Y is an $SO_2$ group; and Q and P together form an —(o—$C_6H_4$)—NH—C(=O)—O—C(=$CH_2$)$CH_3$ group.

The leuco dyes of Formula V may be synthesized from sulfonamido compounds described in U.S. Pat. Nos. 4,258,118; 4,258,119; 4,290,950; 4,290,951; 4,290,955; 4,304,834; 4,307,017; 4,310,673; 4,311,847; 4,316,950; 4,345,017; 4,416,971; 4,429,142 and 4,617,402 (see especially U.S. Pat. No. 4,258,118, column 6, and U.S. Pat. No. 4,345,017, columns 7–8), and from the corresponding amido compounds. These sulfonamido and amido starting materials are those derived from the leuco dyes of Formula V by replacing the —Q—P grouping with a hydrogen atom. These starting materials may be modified to produce leuco dyes of Formula V using reactions which are well described in the literature. Although in theory these starting materials might be condensed in a single step with a reagent containing the desired —Q—P grouping, it is likely to be difficult to carry out such a single-stage condensation under conditions which will not result in at least some separation of the labile leaving group P. Accordingly, in general it is desirable to condense the starting material with a reagent which provides part or all of group Q and which contains a functional group, which provides, or can be modified to provide, an active site for condensation with a second reagent which provides the group P and, if necessary, any remaining part of group Q.

Thus, for example, when the group Q comprises a phenylene group, the sulfonamido or amido starting material may be condensed with an X-fluorobenzene (where X represents a second substituent on the phenyl ring) in the presence of a strong reducing agent, for example sodium hydride, thereby introducing an X-phenyl substituent on the sulfonamido or amido nitrogen atom. The X-phenyl intermediate thus produced may then be condensed directly with a reagent which forms the desired —Q—P grouping; for example, if the —Q—P grouping is to be an —(o—$C_6H_4$)—CH=CH—O—$CH_3$ grouping, X can be o—CHO, and the —(o—$C_6H_4$)—CHO intermediate may be condensed with the Wittig reagent $Ph_3P$=CH—O—$CH_3$ to produce the final leuco dye. In other cases, it may be necessary to modify the group X on the X-phenyl intermediate to provide an appropriate functional group for the second condensation reaction. For example, if Q is to be an —(o—$C_6H_4$)—NH—C(=O)— group, the starting material may be condensed with o-nitrofluorobenzene to attach an o-nitrophenyl group to the nitrogen atom, the nitro group reduced to an amino group, and the resultant aminophenyl compound condensed with a chloroformate containing the desired leaving group P to give the final leuco dye.

A typical synthesis of a leuco dye of Formula V is shown in FIG. 1 of the accompanying drawings. FIG. 1 shows a synthesis of a leuco dye (X), which is the compound of Formula V in which each $R^6$ is a methyl group, each $R^7$ is an o-chlorophenyl group, Y is —$SO_2$—, Q is an o—$C_6H_4$—NH—CO— group and P is an —O—C(=$CH_2$)$CH_3$ group. In this synthesis, the corresponding unsubstituted sulfonamido compound (VII) (which may be prepared by the procedure described in Example 1 of U.S. Pat. No. 4,345,017) is treated with o-nitrofluorobenzene in the presence of a reducing agent, preferably sodium hydride, to give the corresponding N-nitrophenyl derivative (VIII). The nitro group of the derivative (VIII) is reduced, preferably with tin and hydrochloric acid, to give an amino group, thereby producing the aminophenyl compound (IX), which is condensed with isopropenyl chloroformate in the presence of a base, preferably sodium bicarbonate, to give the leuco dye (X).

To prevent premature color formation in an imaging process of the present invention prior to the heating/imaging step, and thus avoid the increase in $D_{min}$ which may occur when some prior art thermal imaging media are stored for long periods before use, advantageously, prior to the heating/imaging step, the squaric acid derivative and the acid-sensitive material are in admixture with an amount of a basic material insufficient to neutralize all the acid liberated by the squaric acid derivative during the heating (and preferably the quantity of basic material is such that it will neutralize not more than 10 percent of the acid which could be generated by complete breakdown of the squaric acid derivative), so that the acid liberated by the squaric acid derivative during the heating neutralizes all of the basic material and leaves excess acid sufficient to effect the color change of the acid-sensitive material. The provision of this small amount of basic material thus serves to "soak up" minor amounts of acid generated by slow thermal decomposition of the squaric acid derivative at ambient temperature during storage.

Persons skilled in the imaging art will appreciate that this technique for preventing premature color formation by including a small amount of basic material in the imaging medium can be applied to thermal imaging media and processes using acid generators other than squaric acid derivatives, and accordingly this invention extends to these other imaging media and processes using this technique for preventing premature color formation.

In the present process, heat may be applied or induced in a variety of ways, for example, by direct application of heat using a thermal printing head or thermal recording pen or by conduction from heated image-markings of an original using conventional thermographic copying techniques. Preferably, heat is generated within the layer containing the squaric acid derivative itself by the conversion of electromagnetic radiation into heat, and preferably the light source is a laser emitting source such as a gas laser or semiconductor laser diode, preferably an infra-red laser. The use of a laser beam is not only well suited for recording in a scanning mode but by utilizing a highly concentrated beam, radiant energy can be concentrated in a small area so that it is possible to record at high speed and high density. Also, it is a convenient way to record data as a heat pattern in response to transmitted signals, such as digitized information.

Since most of the squaric acid derivatives used in the present imaging medium do not absorb strongly in the infra-red, in the imaging process of the present invention the imaging medium desirably comprises an absorber (which may also be referred to hereinafter as an "infra-red dye") capable of absorbing infra-red radiation and thereby generating heat in the imaging layer. Thus, in a preferred embodiment of the present process, the squaric acid derivative and the acid-sensitive material are admixed with an absorber material which can generate heat upon exposure to actinic radiation, and the heating is effected by irradiating the absorber material with actinic radiation, desirably near infra-red radiation (in the wavelength range of 700–1200 nm, preferably 800–1200 nm). Obviously, the absorber should be in heat-conductive relationship with the squaric acid derivative, for example, in the same layer as the squaric acid derivative or in an adjacent layer. Though an inorganic compound may be employed, the infra-red absorber preferably is an organic compound, such as a cyanine, merocyanine, squarylium, thiopyrylium or benzpyrylium dye, and preferably, is substantially non-absorbing in the visible region of the electromagnetic spectrum so that it will not contribute any substantial amount of color to the $D_{min}$ areas, i.e., the highlight areas of the image.

An especially preferred form of imaging medium of the present invention has at least two imaging layers, the at least two imaging layers comprising acid-sensitive compounds arranged to produce dye compounds having differing colors, and comprising absorbers absorbing at differing wavelengths. The at least two imaging layers may contain the same squaric acid derivative. The infra-red absorbers are desirably selected such that they absorb radiation at different predetermined wavelengths above 700 nm sufficiently separated so that each imaging layer may be exposed separately and independently of the others by using infra-red radiation at the particular wavelengths selectively absorbed by the respective infra-red absorbers. As an illustration, three imaging layers containing yellow, magenta and cyan color-forming compounds could have infra-red absorbers associated therewith that absorb radiation at 792 nm, 848 nm and 926 am, respectively, and could be addressed by laser sources, for example, infra-red laser diodes, emitting laser beams at these respective wavelengths so that the three imaging layers can be exposed independently of one another. While each layer may be exposed in a separate scan, it is usually preferred to expose all of the imaging layers simultaneously in a single scan using multiple laser sources of the appropriate wavelengths. Instead of using superimposed imaging layers, the acid-sensitive compounds and associated infra-red absorbers may be arranged in an array of side-by-side dots or stripes in a single recording layer. In such multi-color imaging media, the acid-sensitive compounds may produce the subtractive primaries yellow, magenta and cyan or other combinations of colors, which combinations may additionally include black. The acid-sensitive compounds generally are selected to give the subtractive colors cyan, magenta and yellow, as commonly employed in photographic processes to provide full natural color.

Where imagewise heating is induced by converting actinic radiation to heat, the imaging medium may be heated prior to or during the heating/imaging step. Such heating may be achieved using a heating platen or heated drum or by employing an additional laser beam source or other appropriate means for heating the medium element while it is being exposed.

The imaging media of the present invention may comprise a support carrying at least one layer containing the squaric acid derivative and acid-sensitive compound and may contain additional layers, for example, a subbing layer to improve adhesion to the support, interlayers for thermally insulating the imaging layers from each other, infra-red absorbing layers as discussed above, an anti-abrasive top-coat layer (which also may function as an ultraviolet protecting layer by including an ultraviolet absorber therein), and other auxiliary layers. To give good protection against ultra-violet radiation, ultra-violet screening layers are desirably provided on both sides of the imaging layers; conveniently, one of the ultra-violet screening layers is provided by using as the support a polymer film containing an ultra-violet absorber.

The support employed may be transparent or opaque and may be any material that retains its dimensional stability at the temperature used for image formation. Suitable supports include paper, paper coated with a resin or pigment, such as, calcium carbonate or calcined clay, synthetic papers or plastic films, such as polyethylene, polypropylene, polycarbonate, cellulose acetate and polystyrene. The preferred material for the support is a polyester, desirably poly(ethylene terephthalate).

Usually the layer containing the squaric acid derivative and the acid-sensitive material also contains a binder and is formed by combining the squaric acid derivative, acid-sensitive material and a binder in a common solvent, applying a layer of the coating composition to the support and then drying. Rather than a solution coating, the layer may be applied as a dispersion or an emulsion. The coating composition also may contain dispersing agents, plasticizers, defoaming agents, coating aids and materials such as waxes to prevent sticking where thermal recording heads or thermal pens are used to apply the heat. In forming the layer(s) containing the squaric acid derivative, acid-sensitive materials and the interlayers or other layers, temperatures should be maintained below levels that will initiate the decomposition of the squaric acid derivative so that the acid-sensitive materials will not be prematurely colored or bleached.

Examples of binders that may be used include poly(vinyl alcohol), poly(vinyl pyrrolidone), methyl cellulose, cellulose acetate butyrate, styrene-acrylonitrile copolymers, copolymers of styrene and butadiene, poly(methyl methacrylate), copolymers of methyl and ethyl acrylate, poly(vinyl acetate), poly(vinyl butyral), polyurethane, polycarbonate and poly(vinyl chloride). It will be appreciated that the binder selected should not have any adverse effect on the squaric acid derivative or the acid-sensitive material incorporated therein. Also, the binder should be heat-stable at the temperatures encountered during image formation and it should be transparent so that it does not interfere with viewing of the color image. Where actinic radiation is employed to induce imagewise heating, the binder also should transmit the light intended to initiate image formation.

As explained in more detail in the copending application U.S. Ser. No. 07/696,196, in some thermal imaging media, there is a tendency for one or more of the colored materials produced during imaging to diffuse out of their color-forming layers, but such undesirable diffusion of colored material can be reduced or eliminated by dispersing the leuco dye in a first polymer having a glass transition temperature of at least about 50° C., preferably at least about 75° C., and most preferably at least about 95° C., and providing a diffusion-reducing layer in contact with the color-forming layer, this diffusion-reducing layer comprising a second polymer having a glass transition temperature of at least about 50° C. and being essentially free from the color-forming composition. Desirably, the diffusion-reducing layer has a thickness of at least about 1 μm. The first polymer is desirably an acrylic polymer, preferably poly(methyl methacrylate).

In the present process, it is desirable that, following the heating, fixing of the image be effected by the provision of a quantity of basic material greater than that required to neutralize any acid remaining after the heating, thereby leaving excess base present. Provided an irreversible acid-sensitive material is employed, this post-treatment with base does not affect the color generated, since the irreversible color change of the acid-sensitive material prevents the colored products being decolorized by the added base. Furthermore, this post-treatment renders the color insensitive to later contact with either acid or base; the products of the irreversible color change are inherently insensitive to base, while the excess base introduced by the post-treatment will neutralize any acid accidentally introduced before this acid can cause color change of any unchanged acid-sensitive material remaining. Thus, this post-treatment fixes an image in a manner which is analogous to the fixation of a conventional silver image. In contrast, images produced by conventional imaging systems using acid-sensitive materials which undergo a reversible color change in the presence of acid cannot be fixed in this manner, since the post-treatment with base would destroy the image.

Persons skilled in the imaging art will appreciate that this technique for fixing an image formed with an irreversible acid-sensitive material by flooding the image with an excess of basic material can be applied to thermal imaging media and processes using acid generators other than squaric acid derivatives and irreversible acid-sensitive materials other than those described above, and accordingly this invention extends to these other imaging media and processes using this fixing technique.

In a preferred technique for carrying out the post-treatment with base, a first layer containing the squaric acid derivative and the acid-sensitive material is contacted with a basic polymeric layer having a glass transition temperature such that the basic polymeric layer does not release a substantial amount of base during the heating, and after the heating the basic polymeric layer is heated above its glass transition temperature, thereby permitting the basic polymeric layer to release base into the first layer. An example of such a process is described in more detail in Example 14 below.

The squaric acid derivatives of the present invention can be prepared by known methods, such as those described in U.S. Pat. No. 4,092,146 and Tetrahedron Letters (1977), 4437–38, and 23, 361–4, and Chem. Ber. 121, 569–71 (1988) and 113, 1–8 (1980). In general, the diesters of Formula II can be prepared by reacting disilver squarate with the appropriate alkyl halide(s), preferably the alkyl bromides. The ester groupings may be varied by routine transesterification reactions, or by reacting the diacid chloride of squaric acid with an appropriate alkoxide.

Figure 2:
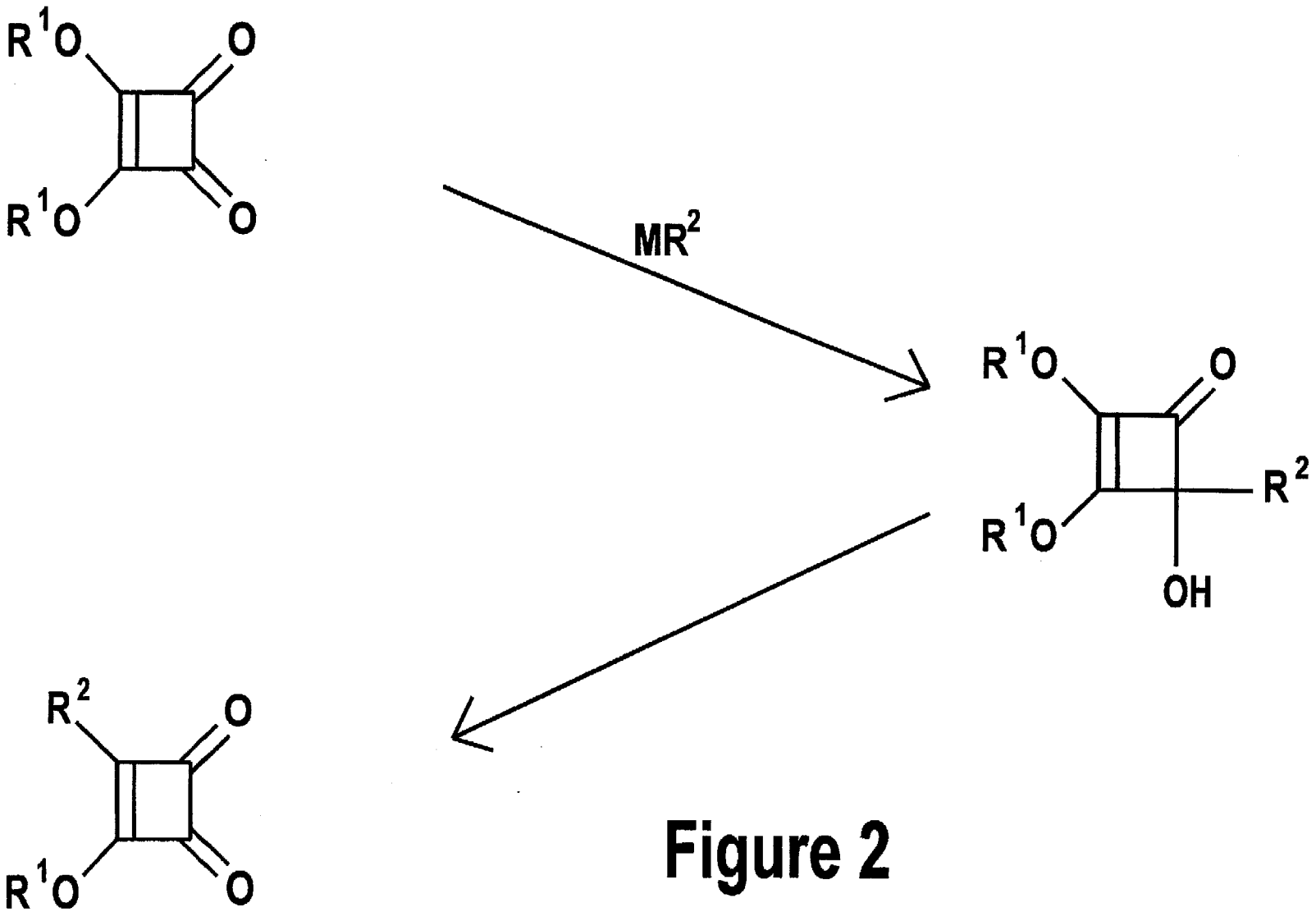
FIG. 2 shows a synthesis of a squaric acid derivative of Formula I below.

The derivatives of Formula I in which $R^2$ is an alkyl, cycloalkyl, aralkyl or aryl group can be prepared from derivatives of Formula II by the synthesis shown in FIG. 2. The diester of Formula II is first condensed with a compound containing a negatively charged species $R^2$; this compound is normally an organometallic compound, and preferably an organolithium compound. The reaction adds the —$R^2$ group to one of the oxo groups of the diester to produce the squaric acid derivative of Formula VI; to avoid disubstitution into both oxo groups, not more than the stoichiometric amount of the organometallic reagent should be used.

After being separated from unreacted starting material and other by-products, the squaric acid derivative VI is treated with an acid, for example hydrochloric acid, to convert it to the desired squaric acid derivative I. Although it is possible to simply add acid to the reaction mixture resulting from the treatment of the diester with the organometallic reagent, this course is not recommended, since the squaric acid derivative I produced may be contaminated with unreacted diester, and the diester and squaric acid derivative I are so similar that it is extremely difficult to separate them, even by chromatography.

It will be appreciated that the synthesis shown in FIG. 2 may be modified in various ways. If, for example, the nature of the group $R^1$ desired in the final compound of Formula I is such that it would react with the organometallic reagent, the reactions shown in FIG. 2 may be carried out with a diester in which the ester groupings do not contain the group $R^1$, and the final product of Formula I may be subjected to transesterification or other reactions to introduce the group $R^1$.

The derivatives of Formula I in which $R^2$ is an amino, alkylamino or dialkylamino group can be prepared by similar methods from squaric acid diesters. For example, as illustrated in the Examples below, reaction of bis(4-vinylbenzyl) squarate with methylamine gives 3-amino-4-(p-vinylbenzyloxy)cyclobut-3-en-1,2-dione. Analogous methods for the synthesis of the other compounds of Formula I will readily be apparent to those skilled in the art of organic synthesis.

The forms of the squaric acid derivative of Formulae I and II in which at least one of $R^1$, $R^2$ and $R^3$ is attached to a polymer may be prepared by reactions analogous to those used to prepare the monomeric derivatives of Formulae I and II, for example by treating a polymer containing appropriate alkoxide groups with the diacid chloride or a monoester monoacid chloride of squaric acid. Alternatively, these polymer-attached derivatives may be prepared by transesterification, for example by treating a polymer containing esterified hydroxyl groups with a monomeric squaric acid derivative of Formula I or II. Other methods for attachment of these derivatives to polymers, or inclusion of these derivatives into polymer backbones, have already been discussed above.

The derivatives of Formula III may be prepared by transesterification from derivative of Formula II, or another squaric acid diester, and the appropriate diol.

Figure 3:
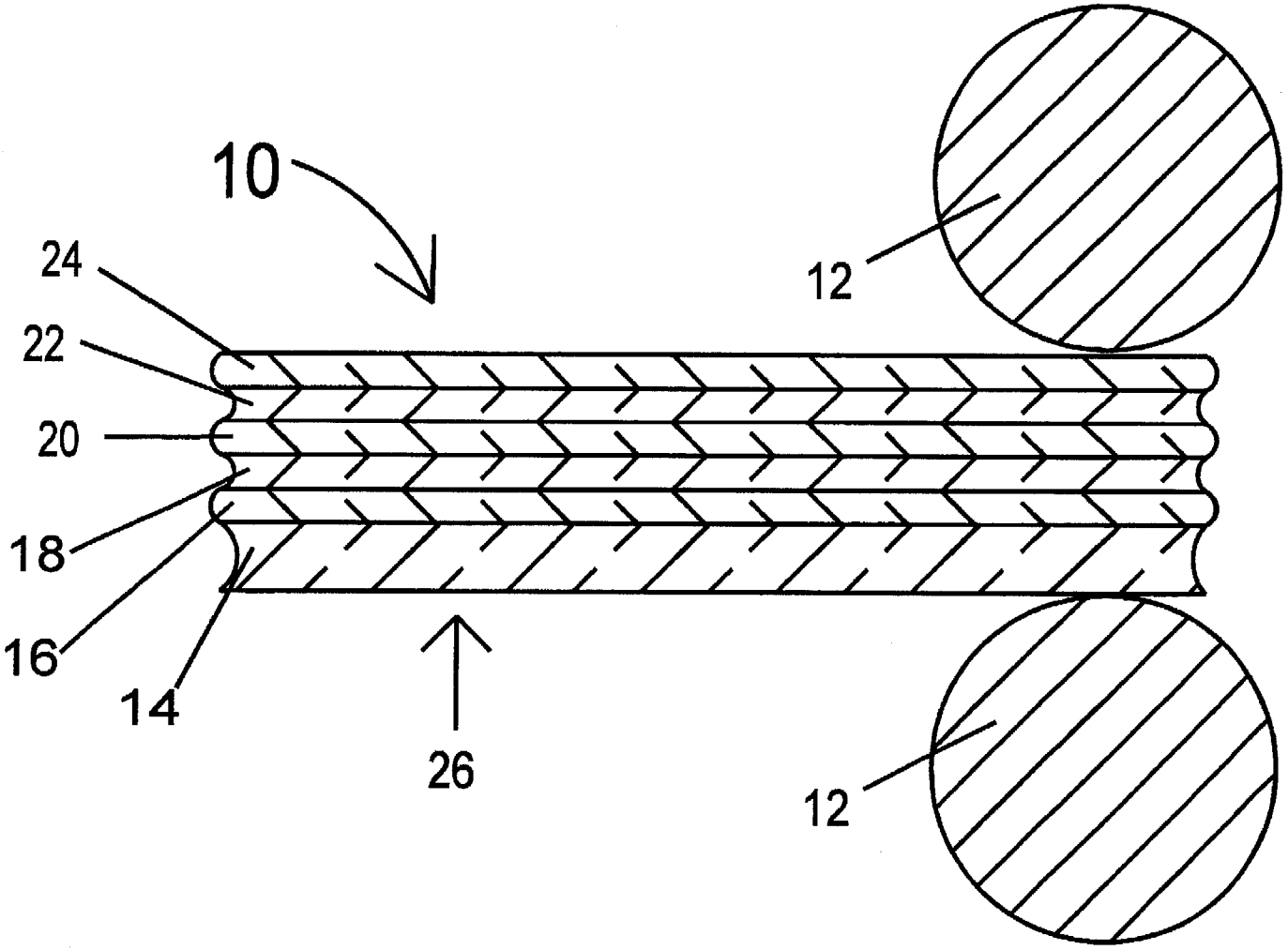
FIG. 3 is a schematic cross-section through an imaging medium of the present invention as the image therein is being fixed by being passed between a pair of hot rollers.

A preferred embodiment of the invention will now be described, though by way of illustration only, with reference to FIG. 3 of the accompanying drawings, which shows a schematic cross-section through an imaging medium (generally designated 10) of the invention as the image therein is being fixed by being passed between a pair of hot rollers 12.

The imaging medium 10 comprises a support 14 formed from a plastic film. Typically the support 14 will comprise a polyethylene terephthalate film 3 to 10 mils (76 to 254 mμ) in thickness, and its upper surface (in FIG. 3) may be treated with a sub-coat, such as is well-known to those skilled in the preparation of imaging media, to improve adhesion of the other layers to the support.

On the support 14 is disposed an imaging layer 16 comprising a squaric acid derivative, an acid-sensitive material (which changes color irreversibly in the presence of the squaric acid or acidic derivative thereof liberated by thermal decomposition of the squaric acid derivative), an infra-red absorber, a hindered amine light stabilizer and a binder. On the opposed side of the imaging layer 16 from the support 14 is disposed a basic layer 18 having a relatively low glass transition temperature. This basic layer 18 may comprise either a basic polymer or a dispersion of a non-polymeric base in a polymer.

A monochromatic imaging medium of the invention may only comprise the three layers 14, 16 and 18. However, the imaging medium shown in the drawing is intended for polychromatic imaging, and further comprises an interlayer 20 and a second imaging layer 22, which can be identical to the imaging layer 16 except that a different acid-sensitive material is employed so that a different color will be produced upon imaging, and a different infra-red absorber absorbing at a different wavelength is employed. A second basic layer 24, which can be identical to the basic layer 18, is provided adjacent the second imaging layer 22.

For simplicity, only two imaging layers are shown in the drawing. However, it will readily be apparent that a three- or four-color imaging medium may be formed by providing, for each additional color desired, a further interlayer, imaging layer and basic layer.

The hindered amine light stabilizer in the imaging layers 16 and 22 provides a small amount of base which serves to neutralize any acid produced by slow thermal breakdown of the thermally unstable acid generator in the imaging layers during storage of the imaging medium.

The imaging medium 10 is exposed by writing on selected areas of the medium with an infra-red laser, this exposure being effected through the support 14, as indicated by the arrow 26 in the drawing. The two imaging layers 16 and 22 are imaged separately using infra-red radiation at two differing wavelengths; alternatively, the two imaging layers may be imaged by controlling the depth of focus of a single laser.

The heating of each imaging layer 16 or 22 by absorption of the laser radiation generates heat within that layer, thereby causing breakdown of the squaric acid derivative therein, release of acid, and the formation of color by the acid-sensitive compound in the exposed regions; the amount of acid generated by thermal breakdown of the squaric acid derivative is more than sufficient to neutralize the hindered amine light stabilizer. The heating is sufficiently localized within the imaging medium 10 that the basic layers 18 and 24 are not heated above their glass transition temperatures even in exposed regions of the image.

After exposure, the imaging medium 10 is passed between the heated rollers 12. The heat and pressure applied by the rollers 12 heats the basic layers 18 and 24 above their glass transition temperatures, thereby causing the basic layer 18 to become intermixed with the imaging layer 16, and the basic layer 24 to become intermixed with the imaging layer 22. This intermixing causes each basic layer to neutralize any acid remaining in the exposed regions of its associated imaging layer, while still leaving excess base available to neutralize any acid later generated as a result of thermal Breakdown of the remaining squaric acid derivative during storage; thus, passage between the rollers 12 fixes the image. Because of the irreversible color change undergone by the acid-sensitive compounds, the fixing step has no effect on the color of the image.

The following Examples are now given, though by way of illustration only, to show details of preferred reagents, conditions and techniques used in the process and imaging medium of the present invention.

3,4-Bis(t-butoxy)cyclobut-3-en-1,2-dione ("bis t-butyl squarate"; hereinafter referred to as "Compound A") used in certain Examples below was prepared as described in E. V. Dehmlow et al., Chem. Ber. 113, 1–8 (1980).

EXAMPLE 1

Preparation of bis(3-bromo-2,3-dimethylbut-2-yl) squarate

This Example illustrates the preparation of 3,4-bis(3-bromo-2,3-dimethylbut-2-oxy)-cyclobut-3-ene-1,2-dione ("bis(3-bromo-2,3-dimethylbut-2-yl) squarate", hereinafter referred to as "Compound AA"), the compound of Formula II in which $R^1$ and $R^3$ are each a 3-bromo-2,3-dimethylbut-2-yl group.

Silver squarate (1.0 g, 3.0 mmol) was added to a solution of 2,3-dibromo-2,3-dimethylbutane (1.0 g, 4.0 mmol) in dry ether (3 mL) at room temperature. The suspension became warm, and was cooled by a water bath at robin temperature. After six hours stirring, the precipitate remaining was removed by filtration, and washed with ether. The combined ether extracts were concentrated, and the crude product obtained therefrom was purified by flash chromatography on silica gel with 1:3 ether/hexanes as eluent to give the diester (140 mg, 11% yield) as a white powder which decomposed at 131°–132° C. The structure of the compound was confirmed by mass spectroscopy and by $^1$H and $^{13}$C NMR spectroscopy.

EXAMPLE 2

Preparation of 3-t-butoxy-4-phenylcyclobut-3-ene-1,2-dione

This Example illustrates the preparation of 3-t-butoxy-4-phenylcyclobut-3-ene-1,2-dione (hereinafter referred to as "Compound B", the compound of Formula I in which $R^1$ is a tertiary butyl group and $R^2$ is a phenyl group.

Phenyl magnesium bromide (4.6 mL of a 1.0M solution in THF, 4.6 mmol) was added dropwise over a period of 5 minutes to a solution of di-t-butyl squarate (1.0 g, 4.42 mmol) in dry ether (10 mL) at −78° C. under nitrogen. After 30 minutes, the reaction mixture was warmed to 0° C., and stirred at this temperature for an additional one hour. Water (10 mL) and ether (10 mL) were then added to the reaction mixture and the layers were separated. The aqueous layer was extracted twice with dichloromethane. The combined organic layers were dried over magnesium sulfate and concentrated, to give a yellow oil (1.43 g), which crystallized. The resultant material was dissolved in dichloromethane (25 mL) and concentrated hydrochloric acid (4 drops) was added, with stirring, to this solution at room temperature. After 30 minutes, a further four drops of concentrated hydrochloric acid were added. Dichloromethane (25 mL) was added, and the resultant solution was washed with a saturated solution of sodium bicarbonate and then with brine, dried over magnesium sulfate, and concentrated. The crude product thus obtained was purified by flash chromatography on silica gel with toluene as eluent. The chromatographed material was further purified by recrystallization from toluene/hexanes to give the desired monoester as yellow crystals (142 mμ, 14% yield) which decomposed at 105°–110° C. The structure of this compound was confirmed by mass spectroscopy and by $^1$H and $^{13}$C NMR, spectroscopy.

EXAMPLE 3

Preparation of 3,4-bis(α-methylbenzyloxy)-cyclobut-3-ene-1,2-dione

This Example illustrates the preparation of 3,4-bis(α-methylbenzyloxy)-cyclobut-3-ene-1,2-dione ("bis(α-methylbenzyl) squarate"; hereinafter referred to as "Compound C"), the compound of Formula II in which $R^1$ and $R^3$ are each an α-methylbenzyl group.

1-Bromo-1-phenylethane (3.1 g, 16.8 mmol) was added dropwise to a suspension of silver squarate (2.5 g, 7.62 mmol, prepared as described in S. Cohen et al., J. Am. Chem. Soc., 88, 5433 (1966)) in dry ether (40 mL) at 0° C. After the addition was complete, the reaction mixture was allowed to warm to room temperature and was stirred for four hours in the dark. The solid remaining after this time (silver bromide) was removed by filtration and washed with more ether. The combined ether solutions were washed with a saturated solution of sodium bicarbonate and dried over sodium sulfate. Evaporation of the solvent was followed by purification by flash chromatography on silica gel with 0–60% ether/hexanes as eluant to give the desired diester (394 mg, 16% yield) as a colorless oil. The diester was obtained as a mixture of diastereoisomers which were not separable by this type of chromatography. The structure of the diester was confirmed by mass spectroscopy and by $^1$H and $^{13}$C NMR spectroscopy.

EXAMPLE 4

Preparation of 3,4-bis(p-methylbenzyloxy)-cyclobut-3-ene-1,2-dione

This Example illustrates the preparation of 3,4-bis(p-methylbenzyloxy)-cyclobut-3-ene-1,2-dione ("bis(p-methylbenzyl) squarate"; hereinafter referred to as "Compound D"), the compound of Formula II in which $R^1$ and $R^3$ are each a p-methylbenzyl group.

Triethylamine (0.93 g, 9.2 mmol) was added to a stirred suspension of squaric acid (0.5 g, 4.38 mmol) in chloroform (10 mL) and the resultant solution was cooled with an ice/water bath. A solution of α-bromo-p-xylene (2.03 g, 11.0 mmol) in chloroform (10 mL) was then added dropwise over a period of 30 minutes. After this time, the cooling bath was removed and the solution was held at room temperature for 4.5 hours. The reaction mixture was then diluted with chloroform (20 mL), washed successively with a saturated aqueous solution of sodium bicarbonate (2×20 mL) and saturated brine (20 mL), dried over magnesium sulfate and concentrated under reduced pressure. The resultant oil was further purified by partition between ether (50 mL) and saturated aqueous sodium bicarbonate (20 mL) and separation of the organic layer. The organic layer was washed successively with a saturated aqueous solution of sodium bicarbonate (20 mL) and saturated brine (20 mL), dried over magnesium sulfate and concentrated under reduced pressure. The oil which resulted was crystallized from hot hexanes (20 mL) to give the desired compound (300 mg, 21.3% yield) as off-white crystals. The structure of this compound was confirmed by mass spectroscopy and by $^1$H and $^{13}$C NMR spectroscopy.

EXAMPLE 5

Preparation of 3,4-bis(cyclohexyloxy)-cyclobut-3-ene-1,2-dione

This Example illustrates the preparation of 3,4-bis(cyclohexyloxy)-cyclobut-3-ene-1,2-dione ("dicyclohexyl squarate"; hereinafter referred to as "Compound E"), the compound of Formula II in which $R^1$ and $R^3$ are each a cyclohexyl group.

Cyclohexyl bromide (9.95 g, 61 mmol) was added dropwise over a period of 20 minutes to a stirred suspension of silver squarate (4.0 g, 12.2 mmol, prepared as described in S. Cohen et al., J. Am. Chem. Soc., 88, 5433 (1966)) in ether (80 mL) in the dark with ice/water cooling. The ice bath was then removed and the reaction mixture was stirred overnight at room temperature, then filtered to remove silver bromide, and the residue was washed with ether (2×20 mL). The ether solutions were combined and washed successively with a saturated aqueous solution of sodium bicarbonate (50 mL) and saturated brine (50 mL), dried over magnesium sulfate and concentrated under reduced pressure to give the desired compound as a viscous oil which solidified upon storage in a refrigerator to give an off-white solid (0.55 g, 16% yield). The structure of this compound was confirmed by mass spectroscopy and by $^1$H and $^{13}$C NMR spectroscopy.

EXAMPLE 6

Preparation of 3-amino-4-(t-butoxy)-cyclobut-3-ene-1,2-dione

This Example illustrates the preparation of 3-amino-4-(t-butoxy)-cyclobut-3-ene-1,2-dione (hereinafter referred to as "Compound F"), the compound of Formula I in which $R^1$ is a tertiary butyl group and $R^2$ is an amino group.

A stream of ammonia gas was passed into a stirred solution of Compound A (0.7 g, 3.07 mmol) in methanol (40 mL) for 2 minutes. The solution was then allowed to stand at room temperature for 1 hour, during which time a small amount of insoluble material was precipitated. The sediment was removed by filtration, and the solvent was removed under reduced pressure to yield a yellow solid, which was washed with ether (2×50 mL) to remove starting material and butanol (0.16 g of impurities were collected, after solvent evaporation). The solid which remained was dissolved in dichloromethane (150 mL) and the solution was filtered. Removal of the solvent under reduced pressure yielded the desired compound as white crystals (0.25 g, 48% yield) which melted at 220°–225° C. The structure of this compound was confirmed by $^1$H NMR spectroscopy.

EXAMPLE 7

Preparation of 4-hexyl-3-(p-vinyl-benzyloxy) cyclobut-3-ene-1,2-dione

This Example illustrates the preparation of 4-hexyl-3-(p-vinylbenzyloxy)-cyclobut-3-ene-1,2-dione (hereinafter referred to as "Compound G"), the compound of Formula I in which $R^2$ is a hexyl group and $R^1$ is an p-vinylbenzyl group.

Part A: Preparation of 2,3-dibutoxy-4-hexyl-4-hydroxycyclobut-2-en-1-one

Hexyl magnesium bromide (40 mL of a 2M solution in ether, 80.0 mmol) was added dropwise over a period of 45 minutes to a solution of di-n-butyl squarate in dry THF (150 mL) at −78° C. under nitrogen, and the reaction mixture was held at that temperature for 1 hour. The reaction mixture was then allowed to warm to room temperature are stirred for an additional 3 hours, after which time it was cooled using an ice/water bath, and quenched by the addition of water (25 mL) added dropwise over a period of 5 minutes. Saturated brine (300 mL) and ether (300 mL) were then added, the layers were separated, and the aqueous layer was extracted with additional ether (300 mL). The ether extracts were combined and dried over magnesium sulfate, and the solvents were removed to give a golden oil (15.64 g) containing the desired product; this oil was used without further purification in Part B below.

Part B: Preparation of 3-hexyl-4-hydroxy-cyclobut-3-en-1,2-one

6N Hydrochloric acid (150 mL) was added in one portion to a stirred solution of crude 2,3-dibutoxy-4-hexyl-4-hydroxycyclobut-2-en-1-one (15.1 g, prepared in Part A above) in THF (150 mL), and the resultant solution was stirred at room temperature for 3 hours. The reaction mixture was then concentrated under reduced pressure to give a yellow solid. To this solid was added water (100 mL), which was then removed under reduced pressure. Toluene (100 mL) was similarly added and removed under reduced pressure, and then dichloromethane (200 mL) was added to the residue and the resultant solution was filtered and concentrated to produce a yellow oil. Hexanes (200 mL) were added and the resultant solution was cooled to induce crystallization. After recrystallization from hexanes, the desired compound was isolated as tan crystals (4.28 g, 33% yield over Parts A and B). The structure of this compound was confirmed by mass spectroscopy and by $^1$H and $^{13}$C NMR spectroscopy.

Part C: Preparation of 4-hexyl-3-(p-vinylbenzyloxy)-cyclobut-3-en-1,2-one

Triethylamine (1.75 g, 17.3 mmol), 2,6-di-t-butyl-4-methylphenol (a radical inhibitor, 0.7 mg, 3.4 μmol) and 4-vinylbenzyl chloride (5.04 g, 33 mmol) were added, in that order, to a solution of 3-hexyl-4-hydroxy-cyclobut-3-en-1,2-one (3.0 g, 16.5 mmol, prepared in Part B above) in chloroform (90 mL), and the resultant solution was heated at reflux for 7 hours. The solution was then cooled and allowed to stand overnight at room temperature, after which it was heated at reflux for a further 7 hours, then cooled and allowed to stand overnight a second time. The reaction mixture was then concentrated under reduced pressure, the residue dissolved in dichloromethane (150 mL), and the resultant solution washed with water (2×75 mL), dried over magnesium sulfate and concentrated under reduced pressure to yield a yellow oil, which was purified by short-path distillation (to remove excess 4-vinylbenzyl chloride) at 72°–74° C. and 1.7 mm Hg pressure. The residue from the distillation was purified by flash chromatography on silica gel with dichloromethane as eluant to give the desired compound (1.23 g, 25% yield) as a golden oil. The structure of this compound was confirmed by mass spectroscopy and by $^1$H and $^{13}$C NMR spectroscopy.

EXAMPLE 8

Preparation of 3-methylamino-4-(p-vinyl-benzyloxy)cyclobut-3-ene-1,2-dione

This Example illustrates the preparation of 3-methylamino-4-(p-vinylbenzyloxy)-cyclobut-3-ene-1,2-dione (hereinafter referred to as "Compound H"), the compound of Formula I in which $R^2$ is a amino group and $R^1$ is an p-vinylbenzyl group.

Part A: Preparation of bis(4-vinylbenzyl)squarate

4-Vinylbenzyl chloride (13 g, 85 mmol) was added to a suspension of silver squarate (freshly prepared from squaric acid (5.5 g, 48 mmol) by the method described in S. Cohen et al., J. Am. Chem. Soc., 88, 5433 (1966)) in dry ether (100 mL), and the resultant mixture was stirred in the dark for 3 days. The reaction mixture was then filtered and the solvent removed under reduced pressure. The residue was taken up in dichloromethane and filtered through a short column of silica gel, then concentrated under reduced pressure, to yield the desired compound in a crude form, which was used in Part B below without further purification.

Part B: Preparation of 3-methylamino-4-(p-vinylbenzyloxy)-cyclobut-3-ene-1,2-dione The crude product from Part A above was dissolved in ether (300 mL) and gaseous methylamine was bubbled through this ether solution for 1 minute. The resultant mixture was allowed to stand for 5 minutes, then the precipitate which had formed was removed by filtration, redissolved in chloroform and filtered through Celite (manufactured by Johns-Manville Corporation, Denver, Colo. 80217). The solvent was removed under reduced pressure to give Compound H as a colorless oil (3.5 g, 30% yield over Parts A and B). The structure of this compound was confirmed by $^1$H NMR spectroscopy.

EXAMPLE 9

Preparation of Copolymer of Compound H with Lauryl Methacrylate

This Example illustrates the preparation of a 1:1 w/w copolymer of Compound H prepared in Example. 8 above with lauryl methacrylate.

Compound H (1 g) and lauryl methacrylate (1 g) were dissolved in a mixture of 2-propanol (30 mL) and ethanol (20 mL), and the resultant solution was purged with nitrogen. Azaisobutyronitrile (0.01 g) was then added, and the solution was held at 65° C. overnight, during which time a precipitate (250 mg) formed. This precipitate was collected and shown by infra-red spectroscopy to contain squarate esters.

EXAMPLE 10

Preparation of 4-[5-[1,2-dioxo-3-hydroxycyclobut-3-en-4-yl]pent-1-yl]-3-hydroxy-cyclobut-3-ene-1,2-dione Pentamethylenebis(magnesium bromide) (25 mL of a 0.5M solution in THF, 12.5 mmol) was added dropwise over a period of 15 minutes to a solution of dibutyl squarate (5.66 g, 25 mmol) in dry THF (50 mL) at −78° C. under a stream of nitrogen. The resulting suspension was stirred at −78° C. for 1 hour, then allowed to warm to room temperature and stirred for a further 2 hours. The homogeneous yellow solution which resulted was cooled to 0° C., and water (10 mL) was added dropwise over a period of 2 minutes. After standing for 5 minutes, the solution was diluted with THF (50 mL) and washed with saturated sodium chloride solution (150 mL). An emulsion was formed, which was separated by evaporative removal of THF and addition of dichloromethane (200 mL). The organic layer was separated and the aqueous layer was extracted with more dichloromethane (100 mL). The combined dichloromethane layers were dried over magnesium sulfate and concentrated under reduced pressure to yield a golden oil which was shown by thin layer chromatography, on silica gel with 1:1 ether/hexanes as eluent, to consist of five components.

This mixture was separated by flash chromatography on silica gel with 1:1 ether/hexanes, followed by pure ether, as eluents. Each of the five components was examined by $^1$H NMR spectroscopy. The third and fourth components (in order of elution from the column) were tentatively assigned as 4-[5-[1,2-dioxo-3-butoxy-cyclobut-3-en-4-yl]pent-1-yl]-3-butoxycyclobut-3-ene-1,2-dione (0.69 g) and 2,3-dibutoxy-4-[5-[1,2-dioxo-3-butoxycyclobut-3-en,4-yl]pent-1-yl]-4-hydroxycyclobut-2-ene-1-one (2.14 g).

A portion of the isolated fourth component (2.01 g) was dissolved in THF (20 mL), and the resultant solution was treated with 6M hydrochloric acid (20 mL). The two-phase mixture became warm, and after 15 minutes stirring was observed to have become homogeneous. After a further two hours stirring, the solution was concentrated to dryness under reduced pressure. Water (20 mL) was added, and removed evaporatively, in order to drive off excess hydrogen chloride. The remaining water was removed by azeotropic distillation under reduced pressure with dichloromethane/acetone, to yield an off-white solid. This material was purified by recrystallization from THF/ether to yield the desired compound as a tan powder (542 mg, 18% yield over two steps). The structure of this compound was confirmed by $^1$H and $^{13}$C NMR spectroscopy.

EXAMPLE 11

Preparation of 4-[5-[1,2-dioxo-3-[4-methylbenzyloxy]cyclobut-3-en-4-yl]pent-1-yl]-3-[4-methylbenzyloxylcyclobut-3-ene-1,2-dione This Example illustrates the preparation of a dimeric squaric acid derivative in which two 4-methylbenzyloxy]cyclobut-3-ene-1,2-dione groups are linked via a pentamethylene chain.

Triethylamine (423 mg, 4.18 mmol) and p-methylbenzyl bromide (1.47 g, 7.96 mmol) were added sequentially to a suspension of 4-[5-[1,2-dioxo-3-hydroxycyclobut-3-en-4-yl]pent-1-yl]-3-hydroxy-cyclobut-3-ene-1,2-dione (526 mg, 2.0 mmol, prepared in Example 10 above) in chloroform (15 mL) at room temperature, and the mixture was then heated at reflux for 9 hours. The solvent was removed under reduced pressure, and the resultant oil was purified by flash chromatography on silica gel with dichloromethane, followed by ether, as eluents. The product eluted with ether, and was obtained as a yellow oil (591 mg, 63% yield). The structure of this compound was confirmed by $^1$H and $^{13}$C spectroscopy.

EXAMPLE 12

Thermal Decomposition of Squaric Acid Derivatives

This Example illustrates the sharp thermal threshold for decomposition characteristic of the squaric acid derivatives used in the processes and imaging materials of this invention.

Thermal gravimetric analysis (TGA) and differential scanning calorimetry (DSC) studies were performed on Compounds A, AA, B and C described above. Both thermal analyses were performed in a nitrogen atmosphere with a temperature ramp of 10° C. per minute to a maximum temperature of 250° C. The decomposition temperature ranges are shown in Table 1 below.

TABLE 1

| Compound | TGA Decomp. temp., °C. | Weight loss, % | DSC Decomp. temp., °C. | Heat released, J/g |
|---|---|---|---|---|
| A | 89–130 | 48.6 | 82–84 | 390.8 |
| AA | 130–175 | 72.0 | 117–160 | * |
| B | 106–140 | 23.9 | 96–125 | * |
| C | — | — | 119–130 | −62.5 |

*Combination of melting and decomposition

EXAMPLE 13

Imaging of Medium of the Invention

This Example illustrates laser imaging of an imaging medium of the present invention.

The leuco dye of Formula VII (see FIG. 1; 3.1 mg), Compound A (6.2 mg), an infra-red absorber of the formula:

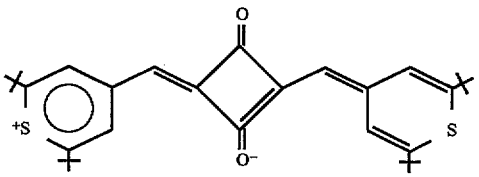

(which may be prepared as described in U.S. Pat. No. 4,508,811; 0.75 mg) and a polymeric binder (poly(methyl methacrylate), Elvacite 2021, available from DuPont de Nemours, Wilmington, Del.; 7 mg) were dissolved in acetone (1 mL), and the resultant solution was coated onto transparent 4 mil (101 μm) poly(ethylene terephthalate) base with a #14 coating rod. After the film had dried, an adhesive transparent tape was applied as a top-coat. The resultant imaging medium had an optical density of 1.1 at 820 nm.

This medium was exposed to laser irradiation from a Candela dye infra-red laser delivering high-energy pulses at 820 nm. The laser output was focussed to a circular spot of diameter 1 mm on the medium. The energies of the laser pulses were varied by the placement of optical filters in the path of the laser. The optical densities achieved with single pulses of 2.5 microsecond duration and varying energy densities are shown in Table 2 below. Each of the entries in Table 2 is an average of the results from two separate measurements at the same laser energy. Optical density measurements at high exposures were found to be affected by migration of colored material to unexposed regions outside the exposed area.

TABLE 2

| Laser Fluence, mJ/cm² | Transmission Green Optical Density |
|---|---|
| 346 | 0.45 |
| 304 | 0.60 |
| 261 | 0.74 |
| 238 | 0.71 |
| 207 | 0.71 |
| 185 | 0.59 |
| 156 | 0.56 |
| 133 | 0.34 |
| 119 | 0.20 |
| 105 | 0.10 |

From the data in Table 2 it will been seen that the medium achieved its maximum green optical density ($D_{max}$) of about 0.70 at a fluence of approximately 200 mJ/cm2.

EXAMPLE 14

Imaging Media Containing Base to Increase Storage Stability

This Example illustrates imaging media of the present invention in which the imaging layer contains a small quantity of base to increase the storage stability of the media.

Three media of the invention were prepared as follows:

Medium A

The leuco dye of Formula VII (6.0 mg), Compound A (6.0 mg), an infra-red absorber of the formula:

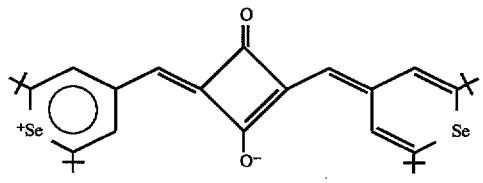

(1.2 mg; this absorber may be prepared by a process analogous to that used in the aforementioned U.S. Pat. No. 4,508,811) and a polystyrene binder (12.0 mg) were dissolved in dichloromethane (0.6 mL), and the resultant solution was coated onto a reflective 7 mil (177 μm) Melinex base (available from ICI Americas, Inc., Wilmington, Del.) with a #8 coating rod. After the film had dried, a protective coat of poly(vinyl alcohol) (Gelvatol 20-90, sold by Monsanto Chemical Corp.) was applied by coating a 5% aqueous solution with a #16 coating rod.

Medium B

This medium was prepared in the same manner as Medium A, except that hindered amine HALS-63 (available from Fairmount Chemical Co., Inc, 117 Blanchard Street, Newark N.J. 07105) (1 mg) was added to the dichloromethane coating solution.

Medium C

This medium was prepared in the same manner as Medium A, except that hindered amine HALS-63 (2 mg) was added to the dichloromethane coating solution.

The three media were exposed to infra-red radiation from a GaAlAs semiconductor diode laser emitting at 867 nm, which delivered 61 mW to the medium. The laser output was focussed to a spot approximately 30×3 μm. The medium was wrapped around a drum whose axis was perpendicular to the incident laser beam. Rotation of the drum about its axis and simultaneous translation in the direction of the axis caused the laser spot to write a helical pattern on the medium. The pitch of the helix was 20 microns, chosen so that none of the medium was left unexposed between adjacent turns of the helix. In this arrangement, the exposure received by the medium was inversely proportional to the speed of rotation of the drum, which is given below as the linear speed (writing speed) at the medium surface.

The green reflection optical densities for the three media are shown in Table 3 below as a function of writing speed. The green reflection optical densities of unexposed samples of the three media were also measured.

TABLE 3

| Writing speed, m/s | Medium A, Green OD | Medium B, Green OD | Medium C, Green OD |
|---|---|---|---|
| Unexposed | 0.19 | 0.19 | 0.19 |
| 1.0 | 1.48 | 1.02 | 0.48 |
| 0.8 | 1.74 | 1.36 | 0.84 |
| 0.7 | 1.92 | 1.70 | 1.15 |
| 0.5 | — | 1.67 | 1.26 |

From Table 3 it can be seen that Media A, B and C reached a green reflection density of about 1.3 at writing speeds of 1.0, 0.8, and 0.5 m/s respectively. The relative sensitivities of the media under these exposure conditions were thus:

A:B:C::1:0.8:0.5.

The dark stabilities of the media were studied at 81° C., 70° C., 60° C., 51° C. and at room temperature (approximately 20° C.). For media B and C the logarithm of the time elapsed before the minimum green optical density ($D_{min}$) of the medium rose more than 0.05 units above its initial value was found to be inversely proportional to the absolute temperature (in accordance with the Arrhenius equation). After this time, which corresponded to exhaustion of the basic threshold (the base initially present in the medium), the green optical density was observed to rise at the same rate as observed initially for Medium A. The time at room temperature before the rise in green optical density exceeded 0.05 units for Media A, B and C was 0.25, 1.25 and 1.85 years respectively (the time for Media A and B was directly observed; for Medium C the time was extrapolated). The stabilities of the three media in the dark at room temperature were thus in the ratios:

A:B:C::1:5:7.4.

Table 4 below shows the variation of $D_{min}$ with storage time at 70° C. for the three media; this variation is qualitatively the same as that obtained at other storage temperatures.

TABLE 4

| Time at 70° C., minutes | Medium A, Green OD | Medium B, Green OD | Medium C, Green OD |
|---|---|---|---|
| 0 | 0.19 | 0.19 | 0.19 |
| 125 | 0.22 | 0.19 | 0.19 |
| 280 | 0.25 | 0.19 | 0.19 |
| 365 | 0.29 | 0.19 | 0.19 |
| 498 | 0.36 | 0.19 | 0.19 |
| 785 | — | 0.19 | 0.19 |
| 937 | — | 0.21 | 0.19 |
| 1092 | — | 0.27 | 0.19 |
| 1160 | — | 0.37 | 0.19 |
| 1215 | — | 0.42 | 0.19 |
| 1345 | 1.38 | 0.71 | 0.20 |
| 1502 | 1.6 | 0.97 | 0.23 |
| 1589 | 1.74 | 1.07 | 0.24 |
| 1657 | 1.83 | 1.2 | 0.34 |

From the data in Table 4, it will be seen that the addition of the small amounts of base the Media B and C greatly increased the storage stability of these media, with Medium C being substantially more stable than Medium B.

EXAMPLE 15

Imaging Medium Using Bleachable Dye

This Example illustrates an imaging media of the present invention using a bleachable dye which decolorizes in the presence of acid.

A coating solution was prepared consisting of:

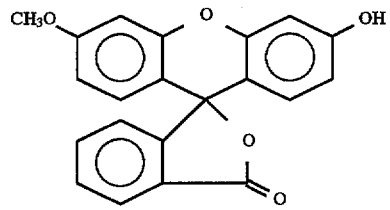

(known as methylfluorocene, 22 mg), 1,8-diazabicyclo [5.4.0]undec-7-ene (DBU, 6 mg), Compound A (10 mg), the infra-red absorber used in Example 13 above (1 mg) and a polymeric binder (polyvinylbutyral, Butvar B-76, supplied by Monsanto Chemical Corp.) in methyl ethyl ketone/dichloromethane solution (10:1, 0.66 mL). This solution was coated onto reflective 4 mil (101 μm) Melinex base using a #8 coating rod. The coated base was dried in an oven at 60° C. for 2 hours, then laminated at 80° C. and 60 psi (0.4 MPa) pressure to a sheet of transparent 4 mil (101 μm) polyvinyl chloride. The polyvinylbutyral binder served as a Thermal adhesive for this lamination.

The resultant imaging medium was imaged using the laser scanning arrangement described in Example 12 above, except that the pitch used in this case was 33 μm. The results are shown in Table 5 below.

TABLE 5

| Writing speed, m/s | Blue Optical Density |
|---|---|
| Unexposed | 1.75 |
| 1.0 | 0.75 |
| 0.8 | 0.61 |
| 0.7 | 0.52 |
| 0.6 | 0.41 |
| 0.5 | 0.42 |
| 0.4 | 0.36 |

EXAMPLE 16

Thermal Imaging Process with Fixing Step

This Example illustrates an imaging process of the invention in which a leuco dye which forms color irreversibly with acid is employed and in which the resultant image is fixed by contacting the imaged medium with an excess of base.

The leuco dye of Formula X (see FIG. 1) was prepared from the intermediate of Formula IX as follows. Isopropenyl chloroformate (0.96 g, 8.01 mmol) was added to a solution of the intermediate (4.87 g, 6.9 mmol) in dichloromethane (50 mL) containing sodium bicarbonate (3.5 g) and the mixture was stirred at room temperature for 4 days. The mixture was then filtered and concentrated under reduced pressure to give a dark red gum, which was triturated with hexanes (50 mL) to yield a solid material which was collected by filtration. Air drying afforded 4.79 g (88% yield) of the desired compound as a pale magenta powder. The structure of this compound was confirmed by mass spectroscopy and by $^{1}H$ and $^{13}C$ NMR spectroscopy.

The three imaging media used in these experiments were prepared as follows:

Medium A

The infra-red absorber used in Example 13 above, Compound A (10.0 mg), the leuco dye of Formula X (see FIG. 1; as noted above, this leuco dye forms color irreversibly with acid) (5.0 mg) and a polymeric binder (polyvinylbutyral, Butvar B-79, supplied by Monsanto Chemical Corp., 30.0 mg) were dissolved in a dichloromethane/methyl ethyl ketone mixture (0.3 mL/0.6 mL). The resultant solution was coated onto a 4 mil (101 μm) poly(ethylene terephthalate) base using a #18 coating rod. The coated base so formed was laminated to a second piece of 4 mil (101 μm) poly(ethylene terephthalate) base at 190° F. (88° C.) and 60 psi (0.4 MPa). The final imaging medium thus produced had an absorbance of 0.76 at 822 nm ($\lambda_{max}$ for the infra-red absorber).

Medium B

This medium was prepared in the same way as Medium A except that the leuco dye of Formula X was replaced by 10.0 mg of the leuco dye of Formula VII (see FIG. 1; as noted above, this leuco dye forms color reversibly with acid). The final imaging medium had an absorbance of 0.82 at 822 nm.

Medium C

This medium was prepared in the same way as Medium A except that the Compound A was omitted; the final imaging medium had an absorbance of 0.83 at 822 nm.

The three imaging media were imaged using the laser scanning arrangement described in Example 6 above, except that the pitch used in this case was 33 μm. Following imaging, the green transmission optical densities of the media were measured.

Thereafter, Media A and B were laminated to a base-containing fixing layer after first peeling the laminated topcoat from the image. The base-containing layer was prepared by dissolving a high molecular weight amine (HALS-62, supplied by Fairmount Chemical Company, 30.0 mg) and a polymeric binder (poly(vinylbutyral), Butvar B-79, 30.0 mg) in methyl ethyl ketone (0.6 mL) and coating the resultant solution onto a 4 mil (101 μm) poly(ethylene terephthalate) base using a #8 coating rod. This base-containing layer was laminated to Media A and B at 190° F. (88° C.) and 60 psi (0.4 MPa), thereby causing the imaging layer to mix with the base-containing layer. The green transmission optical densities of Media A and B were remeasured after lamination to the base-containing layer. Finally, Medium A was heated to 92° C. for 45 hours and its optical density remeasured following this heating; an unfixed specimen of Medium B (i.e., a specimen which had been imaged but not laminated to the base-containing layer) was heated and remeasured in the same manner. The results are shown in Table 6 below.

TABLE 6

| | Green optical density | | | | | | |
|---|---|---|---|---|---|---|---|
| | | | | Medium B | | | Medium |
| Writing | Medium A | | | | | After | C |
| speed, m/s | After imaging | After fixing | After heating | After imaging | After fixing | heating unfixed | After imaging |
| Un-exposed | 0.02 | 0.03 | 0.05 | 0.02 | 0.02 | 1.54 | 0.04 |
| 1.0 | 0.07 | 0.04 | 0.08 | 0.26 | 0.02 | 1.54 | 0.04 |
| 0.9 | 0.11 | 0.06 | 0.11 | 0.35 | 0.02 | 1.54 | 0.04 |
| 0.8 | 0.20 | 0.10 | 0.14 | 0.53 | 0.02 | 1.54 | 0.04 |
| 0.7 | 0.27 | 0.13 | 0.16 | 0.90 | 0.02 | 1.54 | 0.05 |
| 0.6 | 0.43 | 0.20 | 0.20 | 1.23 | 0.02 | 1.54 | 0.07 |
| 0.5 | 0.43 | 0.28 | 0.24 | — | — | — | 0.10 |

From the data in Table 6, it will be seen that Medium C, which lacked the thermal acid generator of the present invention, failed to produce any discernible image, thus demonstrating that the imaging seen with Media A and B was due to acid generation in the media, not thermal imaging of the leuco dye. It will also be seen that, because of the reversible color change undergone by the leuco dye used in Medium B, the attempt to fix the image with base resulted in complete decolorization and removal of the image. Furthermore, the severe heating conditions used in these experiments also destroyed the image in Medium B by producing the maximum optical density throughout the medium. In contrast, although Medium A was initially less sensitive than Medium B, the image produced in Medium A could be fixed and once fixed was able to survive the severe heating conditions without substantial change.

From the foregoing, it will be seen that the present invention provides a process for thermochemical generation of an acid and for forming an image, and a thermal imaging medium, which permits generation of a strong acid at imaging temperatures which readily allow imaging using present technology. Preferred embodiments of the invention provide images which can be fixed, and once fixed these images are very stable against heat.

We claim:

1. An imaging medium comprising an acid generator capable of undergoing thermal decomposition to produce an acid and an acid-sensitive material which undergoes an irreversible color change in the presence of the acid produced by thermal decomposition of the acid generator, such that subsequent neutralization of the acid does not reverse the color change.

2. An imaging medium according to claim 1 wherein the acid sensitive material comprises a leuco dye of the formula:

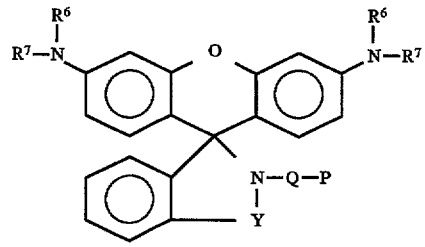

wherein:

each $R^6$ and $R^7$ independently is a group which, together with the intervening nitrogen atom, forms a chromophoric group, subject to the proviso that each adjacent $R^6$ and $R^7$ together with the intervening nitrogen atom may form a nitrogen containing heterocyclic nucleus;

Y is an $SO_2$ or carbonyl group;

P is a leaving group which can separate from the remainder of the leuco dye molecule after protonation of the leuco dye molecule; and Q is a group containing an atom which is not bonded to the nitrogen atom attached to groups Y and Q but which, subsequent to protonation of group P, can form a second bond between group Q and said nitrogen atom, thereby forming a nitrogen containing heterocyclic ring including said nitrogen atom and at least two atoms of group Q, the formation of said second bond being accompanied by the rupture of the bond between said nitrogen atom and the spiro carbon atom to which it is attached.

3. An imaging medium according to claim 2 wherein, in the leuco dye, each of the groups $R^6$ and $R^7$ independently is a substituted or unsubstituted alkyl or aryl group, or each adjacent $R^6$ and $R^7$ together with the intervening nitrogen atom forms a nitrogen-containing heterocyclic nucleus.

4. An imaging medium according to claim 3 wherein, in the leuco dye, each of the groups $R^6$ and $R^7$ independently is a methyl or halophenyl group, or or each adjacent $R^6$ and $R^7$ together with the intervening nitrogen atom forms an indolinyl group.

5. An imaging medium according to claim 2 wherein, in the leuco dye, Y is an $SO_2$ group.

6. An imaging medium according to claim 2 wherein, in the leuco dye, P is a leaving group which upon protonation of the leuco dye causes departure of a ketone, hydroxy-nitrogenous heterocycle or alkanol molecule.

7. An imaging medium according to claim 6 wherein, in the leuco dye, P is a leaving group which upon protonation of the leuco dye causes departure of an acetone or pyridone molecule.

8. An imaging medium according to claim 1 wherein the acid generator and the acid-sensitive material are dispersed in a polymeric binder.

9. An imaging medium according to claim 1 wherein the acid generator is of one of the following formulae:

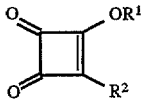

in which $R^1$ is an alkyl group, a partially hydrogenated aromatic group, or an aralkyl group, and $R^2$ is a hydrogen atom or an alkyl, cycloalkyl, aralkyl, aryl, amino, alkylamino, dialkylamino, alkylthio, alkylseleno, dialkylphosphino, dialkylphosphoxy or trialkylsilyl group, subject to the proviso that either or both of the groups $R^1$ and $R^2$ may be attached to a polymer;

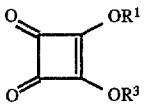

in which $R^1$ and $R^3$ independently are each an alkyl group, a partially hydrogenated aryl group or an aralkyl group, subject to the proviso that either or both of the groups $R^1$ and $R^3$ may be attached to a polymer; and

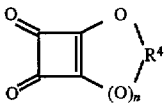

in which n is 0 or 1, and $R^4$ is an alkylene group or a partially hydrogenated arylene group; or comprises at least one unit of the formula:

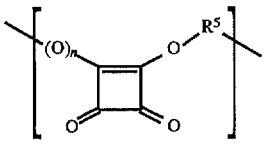

in which n is 0 or 1, and $R^5$ is an alkylene or partially hydrogenated arylene group.

10. An imaging medium according to claim 1 further comprising an absorber material which can generate heat upon exposure to actinic radiation and thereby cause thermal decomposition of the acid generator.

11. An imaging medium according to claim 10 wherein the absorber material will generate heat upon exposure to near infra-red radiation.

* * * * *